US005480066A

United States Patent [19]

Blum

[11] Patent Number: 5,480,066

[45] Date of Patent: Jan. 2, 1996

[54] DEVICE FOR DISPENSING MATERIAL FROM A TUBE

[76] Inventor: Kurt E. Blum, 907 E. Burton St., Murfreesboro, Tenn. 37129

[21] Appl. No.: 278,050

[22] Filed: Jul. 20, 1994

[51] Int. Cl.[6] ..... B65D 35/28

[52] U.S. Cl. ..... 222/103; 222/95; 222/336

[58] Field of Search ..... 222/92, 95, 103, 222/336

[56] References Cited

U.S. PATENT DOCUMENTS

| | | | |
|---|---|---|---|
| 2,759,636 | 8/1956 | Albert | 222/103 |
| 3,211,341 | 8/1965 | Bailey | 222/103 |
| 3,281,016 | 10/1966 | Thompson | 222/103 |
| 3,675,822 | 7/1972 | Casali et al. | 222/103 |
| 4,172,536 | 10/1979 | Holt | 222/103 |
| 4,326,647 | 4/1982 | Pool | 222/103 |
| 4,365,727 | 12/1982 | Shmelkin | 222/97 |
| 4,565,303 | 1/1986 | Gilbertson | 222/103 |
| 5,025,953 | 6/1991 | Doundoulakis | 222/103 X |
| 5,105,984 | 4/1992 | Kazimir | 222/103 |
| 5,145,093 | 8/1992 | Zeller | 222/103 |
| 5,195,660 | 3/1993 | Lekes | 222/103 |

FOREIGN PATENT DOCUMENTS

| | | | |
|---|---|---|---|
| 1210659 | 10/1959 | France | 222/103 |
| 304123 | 2/1917 | Germany | 222/103 |
| 0009187 | 1/1989 | Japan | 222/103 |
| 368274 | 3/1963 | Switzerland | 222/103 |

*Primary Examiner*—Andres Kashnikow
*Assistant Examiner*—Joseph A. Kaufman
*Attorney, Agent, or Firm*—Waddey & Patterson; Edward D. Lanquist, Jr.

[57] ABSTRACT

The present device discloses a first plate and a second plate which are joined by a live hinge. In the preferred embodiment, the first plate, second plate and live hinge are integrally molded from a resilient material. At the ends of first and second plates distally located from the live hinge there are placed elastomeric bands which can be placed over the spout of the squeezable tube to maintain pressure over the length of the tube.

9 Claims, 1 Drawing Sheet

DEVICE FOR DISPENSING MATERIAL FROM A TUBE

BACKGROUND OF THE INVENTION

The present invention relates generally to a device for dispensing material and more particularly to a device for dispensing material from a squeezable tube or collapsible tubular container.

It will be appreciated by those skilled in the art that many materials such as toothpaste, caulk, and the like come in squeeze tubes or collapsible tubular containers. In connection with each of these is the problem of inability to squeeze from the bottom up. Therefore, much of the material in the tube is wasted toward the bottom. Further, there may be a quantity of material left in the tube but it is impossible to squeeze it from the bottom or the top. Even if it is possible to do so, it is very difficult on the user. To this end, there have been several attempts to provide devices which dispense material from the bottom to the top.

This technology is disclosed in U.S. Pat. Nos. 5,105,984; 4,565,303; 4,365,727; 3,675,822; 2,759,636; 3,211,341; 5,145,093; 5,195,660; 4,326,647; and 3,281,016. Each of these devices has a similar feature: a V-shaped object. However, each of these materials have the same flaws. Initially, either of these devices allow the material, once squeezed to a point, to return to the closed end of the tube by allowing the sides of the wedge to be opened or, tail to hold the V-shaped plates with constant pressure over the entire length of the tube and instead maintain pressure at one point of the tube. Also, each of these devices is either very complex or comes in many pieces. None of these devices are easy to manufacture and therefore mass produced.

What is needed, then, is a device for dispensing material from a squeeze tube. This needed device must be capable of efficient, inexpensive, and quick manufacture. This device must be simple. This device must maintain pressure over the entire length of the tube. This device must be made of resilient material. This device is presently lacking in the prior art.

SUMMARY OF THE INVENTION

The present device discloses a first plate and a second plate which are joined by a live hinge. In the preferred embodiment, the first plate, second plate and live hinge are integrally molded from a resilient material. At the ends of first and second plates distally located from the live hinge there are placed elastomeric bands which can be placed over the spout of the squeezable tube to maintain pressure over the length of the tube.

Accordingly, one object of the present invention is to provide a device for dispensing material from a squeeze tube.

Another object of the present invention is to provide a device which is simple, efficient, and easy to manufacture.

Still another object of the present invention is to provide a device which is capable of maintaining pressure along the entire length of the tube.

A still further object of the present invention is to provide a device made of resilient material that allows force to be directed at one area of the tube.

A still further object of the present invention is to provide a device which is a single piece.

DESCRIPTION OF THE PREFERRED EMBODIMENT

Figure 1:
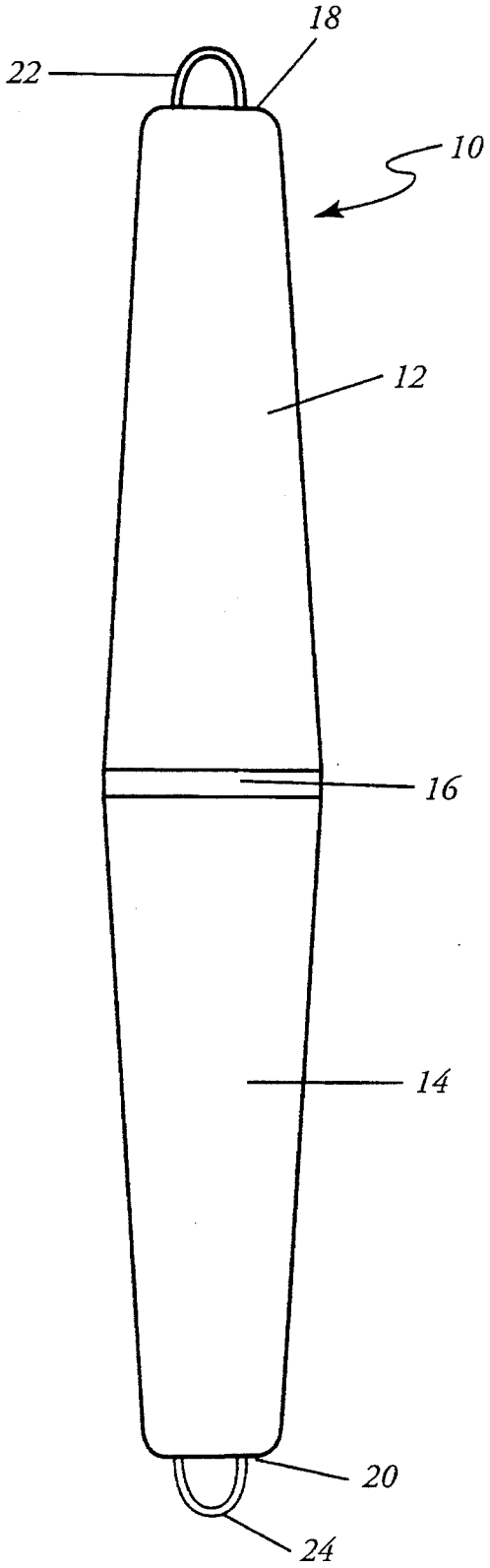
FIG. 1 is a plan view of the device of the present invention.

Referring now to FIG. 1 there is shown generally at 10 the device for dispensing material from a squeezable tube. Device 10 is made of first plate 12, second plate 14, and hinge 16 joining first plate 12 to second plate 14. In the preferred embodiment, hinge 16 is live hinge joining first plate 12 and second plate 14. Also, in the preferred ;embodiment, first plate 12, second plate 14, and hinge 16 are integrally molded. First plate 12 has first distal end 18 and second plate 14 has second distal end 20. Attached to first distal end 18 is first elastomeric band or member 22. Conversely, attached to second distal end 20 is second elastomeric band or member 24. In the preferred embodiment, bands 22, 24 are attached to respective first and second plates 12, 14. However, bands 22, 24 can be integrally molded to first and second plates 12, 14, respectively.

Figure 2:
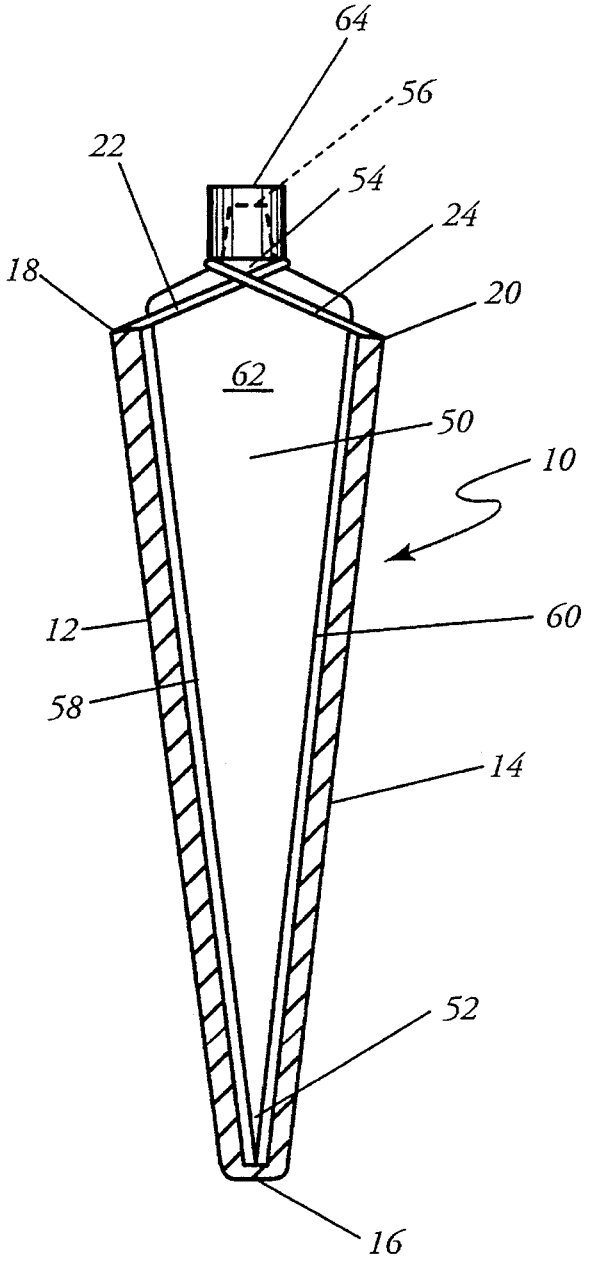
FIG. 2 is a side view of the device of the present invention cooperating with a squeezable tube.

Referring now to FIG. 2 there is shown generally at 10 another view of the device of the present invention. As can be seen, squeeze tube 50 be referred to as collapsible tubular container 50. Tube 50 has closed end 52 and opened end 54. Attached to opened end 54 there is spout 56 which can receive cap 64. Joining closed end 52 to opened end 54 there is first side 58 and second side 60 opposite of first side 58. Inside tube 50 there is placed material 62. This view shows the operation of device 10. Closed end 52 is cradled in device 10 proximate to hinge 16. In the ideal operation, first plate 12 is approximately the same length as first side 58 whereas second plate 14 is approximately the same length as first side 58 whereas second plate 14 is approximately the same length as second side 60. Band 22 and 24 are placed over spout 56 but between cap 64 and opened end 54 so that cap 64 can be placed on spout 56. As force is applied to device 10, material 62 is squeezed from spout 56 or toward spout 56. However, because of its "V" shape, device 10 is capable of directing material 62 along a "V" shape as opposed to getting caught at any flat section. Further, should material gather proximate closed end 52, in the preferred embodiment, device 10 is made of resilient material that allows force to be directed over certain portions of the length of tube 50.

Instead of being integrally molded, device 10 can consist of two plates 12, 14 joined by tape at live hinge 16.

In the preferred embodiment, device 10 can be made of clear plastic, colored plastic, plastic laminate, rubber or acrylic resin fiber composites. In the preferred embodiment, the device would be made of clear or colored plastic.

Thus, although there have been described particular embodiments of the present invention of a new and useful device for dispensing material from a tube, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for dispensing material from a squeeze tube, said squeeze tube having an opened end, a closed end, a spout proximate said closed end, a first side, a second side, and a cap, said device comprising:

a. a first plate;

b. a second plate;

c. a live hinge joining said first plate to said second plate, said first plate, said second plate, and said live hinge integrally molded from a resilient material, said first plate and said second plate approximately equal in length to said first side and said second side;

d. a first elastomeric band attached to said first plate for receiving said spout between said cap and said opened end; and e. a second elastomeric band attached to said second plate for receiving said spout between said cap and said opened end.

2. The device of claim 1 wherein said resilient material is comprised of plastic.

3. A device for dispensing material from a collapsible tubular container, said tubular container having an opened end and a closed end joined by a first side and a second side and having a spout attached to said opened end, said device comprising:

a. a first plate having a first distal end;

b. a second plate having a second distal end;

c. a hinge joining said first plate to said second plate;

d. means attached to said first distal end and said spout for biasing said first distal end toward said spout; and e. means attached to said second distal end and said spout for biasing said second distal end toward said spout.

4. The device of claim 3 wherein said means for biasing said first distal end toward said spout comprises an elastomeric band releasbly attachable to said spout.

5. The device of claim 3 wherein said resilient material is comprised of plastic.

6. A device for dispening material from a collapsible tubular container, said collapsible tubular container having an opened end and closed end joined by a first side and a second side and having a spout attached to said opened end, said device comprising:

a. a first plate having a first distal end;

b. a second plate having a second distal end;

c. a hinge joining said first plate to said second plate;

d. said first plate, said second plate, and said hinge being integrally molded;

e. means attached to said first distal end and said spout for biasing said first distal end toward said spout; and f. means attached to said second distal end and said spout for biasing said second distal end toward said spout.

7. The device of claim 6 wherein said means for biasing said first distal end toward said spout comprises an elastomeric band releasably attachable to said spout.

8. The device of claim 6 wherein said first plate, said second plate, and said live hinge are integrally molded from a resilient material.

9. The device of claim 8 wherein said resilient material is comprised of plastic.

* * * * *